United States Patent [19]

Braun et al.

[11] Patent Number: 4,622,943

[45] Date of Patent: Nov. 18, 1986

[54] FUEL INJECTION PUMP FOR INTERNAL COMBUSTION ENGINES

[75] Inventors: Wolfgang Braun, Ditzingen; Karl Konrath, Ludwigsburg, both of Fed. Rep. of Germany

[73] Assignee: Robert Bosch GmbH, Stuttgart, Fed. Rep. of Germany

[21] Appl. No.: 725,711

[22] Filed: Apr. 22, 1985

[30] Foreign Application Priority Data

May 18, 1984 [DE] Fed. Rep. of Germany ..... 3418437

[51] Int. Cl.[4] ..... F02M 39/00

[52] U.S. Cl. ..... 123/502; 123/179 L; 123/449

[58] Field of Search ..... 123/502, 501, 500, 179 L, 123/449

[56] References Cited

U.S. PATENT DOCUMENTS

| | | | |
|---|---|---|---|
| 4,312,312 | 1/1982 | Höfer | 123/340 |
| 4,387,688 | 6/1983 | Eheim | 123/502 |
| 4,430,974 | 2/1984 | Bofinger | 123/502 |
| 4,457,284 | 7/1984 | Salzgeber | 123/502 |
| 4,489,698 | 12/1984 | Hofer | 123/502 |
| 4,509,470 | 4/1985 | Ito | 123/502 |

*Primary Examiner*—Carl Stuart Miller
*Attorney, Agent, or Firm*—Edwin E. Greigg

[57] ABSTRACT

A fuel injection pump is proposed, which is provided with a hydraulically operating injection adjuster device which is acted upon by a pressure which is determined by the feed pressure of a feed pump driven in synchronism with the fuel injection pump and by the control behavior of a pressure control valve. The pressure control valve has a piston controlling a relief line, and the piston is controllable by means of the pressure to be fed in, counter to the restoring force of a spring, and counter to a pressure controlled via a pressure maintenance valve and a switchable relief valve disposed parallel thereto. The valve is also connected to a device for adjusting the biasing of an idling spring of the governor of the fuel injection pump. With the increasing of the set pressure for the injection adjusting device upon closure of the valve, the biasing of the idling spring and thereby the idling rpm are both increased whenever the instant of injection is shifted toward "early" during starting and warmup.

5 Claims, 2 Drawing Figures

FUEL INJECTION PUMP FOR INTERNAL COMBUSTION ENGINES

BACKGROUND OF THE INVENTION

The invention is based on a fuel injection pump as defined hereinafter. In a known fuel injection pump of this kind, the control of the pressure acting upon the movable wall in the manner of a restoring force is effected with the aid of both a pressure limiting valve and an electromagnetically actuated switching valve. The electromagnetically actuated switching valve is controlled by a control unit, in accordance with a plurality of operating parameters, such that it is closed during cold starting and during the warmup phase. As a result, the pressure in the control pressure chamber is capable of rising very rapidly immediately after fuel injection pump operation begins. The discharge opening is closed by the movable wall at this time, and the pressure on the pressure side of the pressure control valve or in the work chamber of the injection adjusting device very quickly assumes high values in terms of a shift of the instant of injection toward "early". The pressure being established on the pressure side of the fuel feed pump or in the work chamber of the injection adjusting device is limited by the instant of opening of the pressure limiting valve, so that beyond a predetermined fuel injection pump rpm the pressure in the work chamber is not increased further. With an embodiment of this kind, the warmup behavior per se of the internal combustion engine is improved; however, shifting the instant of injection forward is often insufficient to generate smooth engine operation immediately after starting. Especially in the cold state, because of increased friction, engine power losses are so great that at a given injection quantity the idling rpm would decrease considerably. Various proposals have accordingly been made for increasing either the fuel injection quantity, or the idling rpm, during the warmup phase by suitable means.

From German Offenlegungsschrift No. 28 44 910, it is known to increase both the instant of injection and the idling rpm simultaneously by means of a thermostatically actuated mechanical device. In this apparatus, by means of a thermostatic element via a suitable coupling linkage, a mechanical member determining the instant of injection is adjusted, and simultaneously the idling stop, which determines power, on the adjusting member of the fuel injection pump is varied. This adjusting lever is connected to an adjusting member for the biasing the main governor spring, which acts upon a governor lever which on the one hand is acted upon by an rpm-dependent force and on the other hand actuates a quantity adjusting device of the fuel injection pump. This apparatus has the disadvantage that the injection onset adjustment takes place mechanically, and the setting is fixed at a predetermined adjustment angle. Complicated mechanical provisions must also be made in order to effect this adjustment. An engagement opening must be provided in the pump housing, which interrupts the guidance of the cam element or roller ring element effecting the drive of the pump piston of the engine, and this is expensive. Furthermore, the roller ring segment or cam ring element requires a recess for the mechanical adjusting element to engage. Not only does this occasion additional engineering and manufacturing expense, but it generally results in reducing the mechanical strength of the parts and causes an impairment in the bearings of these parts.

OBJECT AND SUMMARY OF THE INVENTION

The fuel injection pump according to the invention has the advantage that the injection adjustment is simply performed hydraulically, without requiring substantial mechanical adjustments in the drive mechanism of the fuel injection pump, and simultaneously a means is provided for increasing the idling rpm in a simple manner in the warmup phase in order to generate good idling behavior of the internal combustion engine.

In accordance with an advantageous feature of the invention, the increase in idling rpm to be attained with the aid of the varied biasing of the idling spring can be performed using only small forces. In contrast to known apparatuses in which the idling stop of the adjusting lever controlling the injection quantity is shifted, the forces to be overcome here are quite small. In the known apparatus, the forces in effect are, first, that of a restoring spring for the adjusting lever and, second, the friction of the linkage, which may be quite complicated, between the gas pedal and the adjusting lever. In an advantageous embodiment of the invention, however, only the biasing force of the idling governor spring and lesser forces of simple transmission are in effect, so that the adjustment of the biasing of the idling spring in individual cases does not need to be separately assured, since self-locking suffices to maintain the adjustment once it has been made. The forces to be exerted by an adjusting member controlled in accordance with operating parameters are correspondingly small.

The invention will be better understood and further objects and advantages thereof will become more apparent from the ensuing detailed description of a preferred embodiment of the invention taken in conjunction with the drawings.

DESCRIPTION OF THE PREFERRED EMBODIMENT

Figures 1, 2:
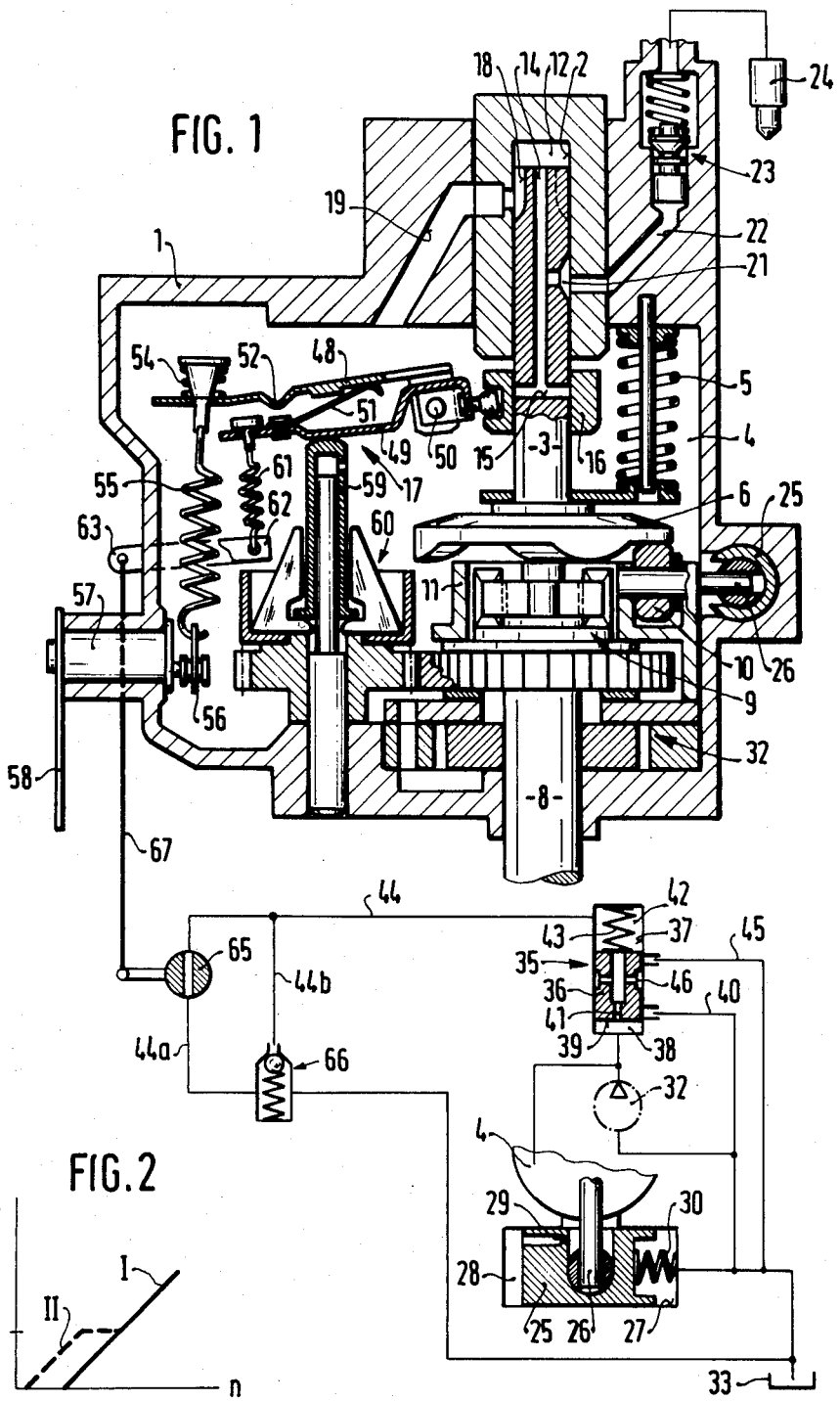
FIG. 1 shows a cross-sectional view of a first exemplary embodiment.
FIG. 2 is a graph illustrating the injection onset control device adjusting path attained with the apparatus according to the invention, plotted over the rpm.

A pump piston 3 operates in a cylindrical bore 2 of a housing 1 of a fuel injection pump. At its end which protrudes into a fuel-filled suction chamber 4 in the housing 1 of the fuel injection pump, the pump piston 3 is retained on a face cam disk 6 by a spring 5 supported on the housing. The face cam disk is set to rotating by a drive shaft 8 via a coupling 9 and rolls off on rollers 10 of a roller ring 11, causing the pump piston to execute simultaneously both a reciprocating pumping movement and a rotating movement.

In the cylindrical bore 2, the pump piston encloses a work chamber 12 at its end, which can be made to communicate with the pump suction chamber via a longitudinal bore 14 beginning at the end of the pump piston and a transverse bore 15 located in the vicinity of the part of the pump piston that continually plunges into the suction chamber. The opening of the transverse bore 15 into the suction chamber is controlled by an annular slide 16, the axial position of which is adjusted by a governor 17. The pump piston furthermore has intake grooves 18, which when it rotates alternatively communicate with intake bores 19 and serve to fill the pump work chamber with fuel. From the longitudinal bore 14, a connection also leads to a distributor groove 21 on the jacket face of the pump piston. When the pump piston rotates during its supply stroke, the distributor groove is brought into communication successively with one of a plurality of injection lines 22 beginning at the cylindrical bore 2. These lines lead via a check valve 23, which may be embodied as a relief valve if desired, to an injection valve 24 of the engine.

The instant at which the supply stroke of the pump piston begins depends on the relative position of the roller ring 11, which is rotatably supported in the housing 1 and is adjustable by means of an injection adjuster piston 25. In this manner, the stroke onset of the face cam disk 6 is adjusted with respect to a predetermined rotational angle of the drive shaft 8. The injection adjuster piston is coupled with the cam ring 11 via a pin 26 and is displaceable in a cylinder 27. On one end of the closed cylinder, the injection adjuster piston encloses a work chamber 28 which communicates via a throttle 29 with the suction chamber 4. For the sake of better comprehension, the injection adjuster piston and the work chamber 28 are again shown separately in FIG. 1, in a sketch illustrating the principle by which they operate. This part of the drawing also clearly shows the course of the hydraulic lines which will be described below.

The other side of the injection adjuster piston is engaged by a restoring spring 30, against which the injection adjuster piston is displaced when the pressure in the suction chamber rises.

The suction chamber 4 is supplied with fuel from a fuel supply container 33 by a feed pump 32, which is also driven by the drive shaft 8. To attain an rpm-dependent fuel pressure in the suction chamber 4 and thus to attain an rpm-dependent adjustment of the cam ring, a pressure control valve 35 is provided, which comprises a movable wall, in this case a piston 36, the end 39 of which encloses a work chamber 38 in a cylinder 37 which guides this piston. The work chamber 38 communicates with the suction chamber 4 and can be made to communicate, via a relief line 40 leading laterally away from the cylinder 37 and the opening of which line is controlled by the end 39 of the piston 36, with a relief chamber, for instance the supply container 33. A throttle connection 41 also leads from the end 39 through the piston 36 to a spring chamber 42, which is enclosed on the other end of the cylinder 37 by the piston 36 and in which a restoring spring 43 acting upon the piston 36 is disposed. The spring chamber 42 can also be made to communicate, via a second relief line 44, with the fuel supply container 33, regardless of the position of the piston. A third relief line 45 also leads away from the cylinder 37, and it can be made to communicate with the spring chamber 42, prior to the complete opening of the first relief line 40, via a control face 46 on the piston 36.

With the aid of the pressure control valve 35 and of the feed pump 32 driven in synchronism with the fuel injection pump, a pressure which increases in accordance with rpm is generated in the pump suction chamber, causing an rpm-dependent adjustment of the injection adjuster piston and thus an adjustment of the roller ring.

The control of the injection quantity is effected via the governor 17, which in a known manner is embodied as a governor lever assembly comprising a tensioning lever 48 and a starting lever 49. The tension lever is realized as a one-armed lever, which rotates about the same, optionally adjustable shaft that the starting lever, embodied as a two-armed lever, is supported on. One arm of the starting lever is coupled with the annular slide 16, while the other arm of the starting lever carries a starting spring 51, which is located between the tensioning lever 48 and the starting lever 49, and after it is compressed the starting lever comes to rest on a stop 52 of the tensioning lever. Via an intermediate spring 54, a governor spring 55 is attached to the tensioning lever, being secured on its other end on a lever arm 56. The lever arm 56 is seated on a shaft 57, which is guided through the wall of the housing 1 and can be rotated from the outside by means of an adjusting lever 58. With this lever 58, the biasing of the governor spring 55 and intermediate spring 54 is varied. In the event that the governor spring is realized as a biased spring, then the adjusting lever 58 adjusts the tensioning lever directly, and speed regulation is effected after the biasing of the biased spring 55 has been overcome.

An adjusting sleeve 59 of an rpm transducer 60 comes to rest on the starting lever 49, which with increasing rpm effects the speed regulation of the injection quantity. The rpm transducer is driven in synchronism with the fuel injection pump. Also engaging the end of the starting lever 49 is an idling governor spring 61, the other end of which is secured to a lever arm 62. The lever arm 62, similarly to the lever arm 56, is seated on a shaft guided through the housing 1 to the outside, and an actuation lever 63 is seated on the other end of this shaft. The biasing of the idling governor spring 61 can be adjusted via this actuation lever 63.

The governor functions as follows:

Upon starting, the starting lever 49 is retained by the starting spring 51 on the adjusting sleeve 59, which is located in the starting position. In so doing, the starting spring 51 keeps the starting lever spread away from the tensioning lever 48. The annular slide 16 is moved into its highest position, so that the pump piston can execute virtually its full stroke before the transverse bore 15 is opened by the annular slide 16. This represents the maximum fuel injection quantity. With increasing rpm, the rpm transducer shifts the starting lever 49 toward the tensioning lever 48 until it comes to rest against the stop 52. In the intermediate range, the effect of the idling governor spring 61 comes into play. In the partial-load range, the position of the adjusting lever 58, that is, the force exerted by the governor spring 55 upon the tensioning lever 48, determines the fuel injection quantity. If the rpm exceeds the authorized rpm that has been established, then the tensioning lever 48 is shifted together with the starting lever 49 by the rpm transducer counter to the force of the governor spring 55. The fuel quantity is thereby controlled such that the established maximum rpm is not exceeded. In the intermediate range, the intermediate spring 54 can come into play for adaptation purposes.

In order to adapt the instant of injection to engine conditions during cold starting and in the warmup phase, a deviation from purely rpm-dependent control of the injection onset is necessary. To this end, the second relief line 44 leads in a first branch **44*a* via a valve 65 and in a second branch 44*b* via a pressure maintenance valve 66, which opens toward the relief side once the pressure established at it is exceeded. The valve 65 is mechanically coupled to the lever 63 via a linkage 67 and is actuatable either simultaneously with this linkage or after a relative delay thereof. The actuation of the linkage can be effected manually or by a temperature-controlled adjusting element or by some adjusting element triggered by a control unit which detects various engine operating parameters. With the valve 65, the relief line branch 44***a* is closed upon actuation, and simultaneously or after a delay, the biasing of the idling spring 61 is increased. This causes the quantity flowing out through the throttle 41 accommodated in the piston 35 to generate in the spring chamber 42, now serving as the control pressure chamber, of the pressure control valve a pressure which is determined by the opening pressure of the pressure maintenance valve 66. This counterpressure effects a simultaneous increase in the pressure in the suction chamber 4 and thus causes a shift of the injection adjuster piston toward "early". This pressure increase results in an injection adjuster course represented by curve II in FIG. 2. As this graph shows, a shift of the injection adjuster already occurs at a substantially lower rpm than during normal operation, in which the valve 65 is opened. Curve II also shows that by skillful and precise positioning of the control location 46 on the piston 36, an abrupt change in course of the injection adjuster path over the rpm can be attained. This means that by means of the quantity flowing out via the relief line 40 and 45, only a slight pressure rise then takes place in the suction chamber 4, until an injection adjuster course according to curve I, for normal operation, has been attained. The control location 46 with the relief line 45 assumes a safety function here, in the event that the valve 65 does not open despite a warm engine, thereby preventing thermal overload of the engine.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a housing, a suction chamber in said housing, a pump piston, a face cam disk and a roller means in said housing for simultaneously reciprocating and rotating said pump piston, an injection adjuster means for adjusting said roller means to control the instant at which a supply stroke of said piston begins, said injection adjuster means including an injection adjuster piston, a first work chamber at one end of said injection adjuster piston which communicates with said suction chamber via a throttle in said injection adjuster piston, a pressure control valve, said pressure control valve including a movable wall acted upon on one end by a restoring force in a spring chamber and on its opposite end by fluid pressure in a second work chamber, a fuel feed pump driven in synchronism with said fuel injection pump, said fuel feed pump including a pressure side which communicates with said second work chamber of said pressure control valve and said suction chamber, said movable wall of said pressure control valve adapted to control a discharge opening to a first relief line and a second relief line connected to said spring chamber, said spring chamber arranged to communicate via a throttle restriction with said pressure side of said feed pump and via a third relief line with a fuel supply container, said third relief line arranged to communicate with a first pressure limiting valve in a first branch line and a second pressure limiting valve located in a second branch line, said first pressure limiting valve mechanically coupled with an adjustable element which is coupled with one end of an idling spring with the opposite end of said idling spring coupled with a governor lever of said fuel injection pump, whereby in a closed position of said first pressure limiting valve the biasing of said idling spring is increased.

2. A fuel injection pump as defined by claim 1, further wherein said first pressure limiting valve is adjustable in accordance with a temperature affecting engine operating behavior.

3. A fuel injection pump as defined by claim 2, further wherein said first pressure limiting valve is actuated by means of a temperature-controlled adjusting element.

4. A fuel injection pump as defined by claim 1, further wherein said governor lever is further connected to a main spring and biasing of said idling spring is variable independently of the setting of said main governor spring.

5. A fuel injection pump as defined by claim 4, further wherein said idling spring acts upon a governor lever embodied as a starting lever, said starting lever coupled with a quantity adjusting device, said governor lever actuable by an rpm-dependent force and adapted to be brought counter to the force of a starting spring into contact with a second governor lever embodied as a tensioning lever, said starting spring positioned between said tensioning lever and said starting lever, and said tensioning lever acted upon by said governor spring counter to the operative direction of said rpm-dependent force.

* * * * *